United States Patent [19]

Lorenz et al.

[11] 4,248,670

[45] Feb. 3, 1981

[54] DEVICE FOR PRODUCING ABRASION-PROOF COKE FORMS

[75] Inventors: Kurt Lorenz, Hattingen; Horst Dungs, Herne, both of Fed. Rep. of Germany

[73] Assignee: Firma Carl Still GmbH & Co. KG, Fed. Rep. of Germany

[21] Appl. No.: 32,247

[22] Filed: Apr. 23, 1979

[30] Foreign Application Priority Data

Apr. 27, 1978 [DE] Fed. Rep. of Germany ..... 2818419

[51] Int. Cl.[3] ..... C10B 49/06

[52] U.S. Cl. ..... 202/99; 201/34; 202/121; 202/125; 202/126; 202/150; 432/95

[58] Field of Search ..... 201/6, 34, 36, 37, 43, 201/44; 202/120, 121, 150, 124, 125, 126, 127, 99; 208/8 R; 48/197 R, 210; 432/13, 14, 16, 18, 31, 95, 100; 44/10 R, 10 C, 10 J, 10 K; 34/64, 165, 169, 170

[56] References Cited

U.S. PATENT DOCUMENTS

| | | | |
|---|---|---|---|
| 474,676 | 5/1892 | Morton | 34/170 X |
| 698,129 | 4/1902 | Niese | 34/170 |
| 742,723 | 10/1903 | Newhall | 202/150 |
| 1,713,032 | 5/1929 | Debauche | 202/124 |
| 1,758,524 | 5/1930 | Koppers | 202/126 |
| 1,893,417 | 1/1933 | Komarek et al. | 44/10 K |
| 2,548,295 | 4/1951 | Fahnestock | 34/170 X |
| 2,947,670 | 8/1960 | Hobson | 202/120 X |
| 3,172,823 | 3/1965 | John et al. | 202/121 X |
| 3,316,155 | 4/1967 | Holowaty et al. | 201/34 X |
| 3,536,590 | 10/1970 | Tsujihata et al. | 202/126 X |
| 3,595,540 | 7/1971 | Whitcombe | 432/100 X |
| 3,918,929 | 11/1975 | Schmalfeld et al. | 44/10 K |
| 4,115,202 | 9/1978 | Lorenz et al. | 202/121 X |

FOREIGN PATENT DOCUMENTS

| | | | |
|---|---|---|---|
| 1498 | 8/1967 | Australia | 201/6 |
| 339743 | 10/1918 | Fed. Rep. of Germany | 202/120 |
| 111871 | 12/1917 | United Kingdom | 202/120 |
| 158394 | 2/1921 | United Kingdom | 201/37 |

*Primary Examiner*—Frank W. Lutter
*Assistant Examiner*—Roger F. Phillips
*Attorney, Agent, or Firm*—McGlew and Tuttle

[57] ABSTRACT

A device for producing abrasion-proof coke forms from bituminous or brown coal briquettes, charcoal or peat, comprising, a preheating stage, a dehydrating stage, a carbonization stage and a cooling stage, each stacked in a column to form a tower furnace. Each of the stages include an annular zone for receiving the coal or charcoal material and each stage is supplied with a separate and independent gas circuit. Each annular zone is formed between an inner substantially cylindrical jacket and an outer substantially cylindrical jacket with a shaft space defined in the inner cylindrical jacket. Heaters for the gas circuits of the preheating, dehydrating and carbonizing stages are disposed in the shaft space.

26 Claims, 21 Drawing Figures

DEVICE FOR PRODUCING ABRASION-PROOF COKE FORMS

FIELD AND BACKGROUND OF THE INVENTION

The present invention relates to coke oven constructions in general and, in particular, to a new and useful device for producing abrasion-proof coke forms from bituminous or brown coal briquettes, charcoal or peat which comprises concentric inner and outer jackets forming a tower furnace with stacked processing zones for the coal material.

DESCRIPTION OF THE PRIOR ART

A method for producing abrasion-proof coke forms is known from German Pat. No. 2,507,735, which teaches that for producing abrasion-proof coke forms from brown coal briquettes, with a low content of sulphur and ash, the brown coal briquettes are preheated, dehydrated or predried, coked, and cooled by means of gases which substantially consist of burned gases of the carbonization process. These are circulated in closed circuits, with each of these operations taking place in a separate stage and with the gas circuits of preheating, drying and carbonization being heated separately.

According to a variation of this method (German Pat. No. 2,537,191), to adjust a definite partial pressure of steam relative to the briquettes to be dried and preheated, steam is admixed with the circulating gases of the preheating and drying stages prior to their entrance into the stages. The method is not reduced to a definite device. However, the device disclosed in German Pat. No. 2,507,735 has proven to be completely satisfactory for coking brown coal briquettes and in this device, the installations for carrying out the operations in the individual stages are superposed one above the other.

It has now been found, in practice, however, that in this design, the cost of the foundation, anchoring, and propping are in an unfavorable proportion to the performance and output of the device and method.

SUMMARY OF THE INVENTION

This invention is directed to an arrangement or spatial disposition of a device, similar to that mentioned above. In the invention, however, the relation of the expenses to the performance is satisfactory, i.e., the output relative to the entire expenditures in building the plant are more favorable than in the installations of the prior art.

Accordingly, an object of the present invention is to provide a device for producing abrasion-proof coke forms from bituminous or brown coal briquettes, charcoal or peat, comprising, a preheating stage having a preheating zone, a preheating gas circuit for supplying gas to said preheating zone and a heater in said preheating gas circuit, a dehydrating stage having a dehydrating zone, a dehydrating gas circuit for supplying gas to said dehydrating zone and a heater in said dehydrating gas circuit, a carbonization stage having a carbonization gas circuit for supplying gas to said carbonization zone and a heater in said carbonization circuit, and a cooling stage having a cooling zone and a cooling gas circuit for supplying gas to the cooling zone. An inner circular cross-sectioned jacket and an outer circular cross-sectioned jacket each define an annular space therebetween which forms the zones of the various stages, each of the various stages being stacked to form a tower furnace with the heaters disposed within a shaft space defined by the inner circular cross-sectioned jacket.

A further object of the invention is to provide a device for producing abrasion-proof coke forms which is simple in design, rugged in construction and economical to manufacture.

The heating installations of the coking stage may also be disposed partially or completely in the inner shaft of the tower furnace.

In accordance with the invention, the symmetry of the plant arrangement provides possibilities of simplifying the foundation, the anchoring and the propping of the structure, of balancing the thermal stresses and better disposing the pipings between the gas heaters accommodated in the inner shaft of the tower furnace and the different stages or zones. Thermal losses are also substantially reduced and the expensive end walls and battery heads necessary in the prior art structures are saved.

A method has been provided for preventing the coal dust generated from depositing in and on the briquette charges and the connecting lines, particularly, in the preheating and drying stages, which would hinder the passage of the preheating and drying gases through the charges. For this purpose, hot inert combustion gas is admixed with the gases escaping from the briquette charges, in an amount such that the total of the gases escaping from the stages has a temperature at least 20° C. above the temperature of steam saturation of the gas, whereupon, the hot gases are freed from dust. The hot gases are recycled into the briquette charge of the same stage while evacuating excess amounts of gas.

A particular advantage of the present invention is that it may be simply adapted to carry out the justmentioned method. For this purpose, radial exhaust arms are provided in the upper part of the shaft for preheating and drying, which are provided on their underside with gas openings and through which the waste gases can be evacuated to the outside and which are connected through dust separators to exhausters having their pressure side connected to gas return arms which are provided in the lower part of the stage and have gas openings on their underside, with hot gas supply pipes projecting from the gas heaters into the exhaust arms, and with return pipes to the gas heaters being provided in the gas return arms.

The various zones or stages are heated by hot gases which are introduced into the stages from below. The gases transfer their heat to the briquette charge, absorb water vapor and coal dust, and escape again at the top of the briquette charge. Above the charge, the gases are exhausted in such a manner that the entrained dust does not deposit in or on the charge. These gases are then mixed with hot inert gases which have been freed from dust, and are recycled as heating gas into the same stage. Gases in excess escape at the top of the open tower furnace, in accordance with the pressure equalization.

The exhaust arms and the gas return arms are provided with a cross-section of an acute equalsided triangle with the vertex thereof pointing upwardly. This is advantageous for the downward sliding of the briquette charges in the treated layers. The gas passage through the briquet layers, may further be facilitated by providing the lower edges of the gas return arms with a sawtooth shape.

At the same time, allowance can be made for the fact that the gas amount to be exhausted grows larger from the inside to the outside and that the returning gas amount grows smaller from the outside to the inside. This is obtained by providing that the inner clear cross-sectional area of the exhaust arms and of the return arms narrows from the outside to the inside, to ensure constant gas velocities at varying gas amounts.

To prevent the hot inert gases from transferring their heat to the upper part of the briquette charge through the walls of the exhaust arms, and to preserve their high temperature or their high heat content until they return from below into the stage, the exhaust arms are provided with a thermally insulating layer on their inside surfaces. In this way, condensation and a following deposition of obstructing dust in the apparatus is prevented.

Gas openings are provided in the bottom of the exhaust arms and return arms having the triangular cross-section. The number of these openings grows from the inside to the outside of the tower, in accordance with the varying gas amounts produced at different circumferences, so that the entire cross-sectional area of passage increases from the inside to the outside, with the ratio of the total cross-sectional area of all openings to the cross-sectional area of the outlet aperture in the outside wall of the tower furnace and below the bottoms being 10:1. This outlet aperture is connected to gas discharge devices. In view of the minimum gas velocity to be maintained for the dust evacuation, the vertical distance between the upper edge of the aperture and the lower edge of the exhaust arms is less than 100 mm.

The free horizontal spacing of the exhaust arms and also of the gas return arms in the preheating and drying stages is at least 600 mm. This distance makes allowance for the pressure loss which, incidentally, also depends on the shape of the charged briquettes. The exhaust arms of each stage are connected to an annular duct in which the dust collecting pockets with discharge locks are accommodated. The annular duct is dimensioned to allow the dust entrained by the gas to deposit in an appreciable amount. For this purpose, the gas velocity in the annular ducts is reduced to less than 1 meter per second.

If the produced coke is to be used predominantly in metallurgical or other industrial plants, a small reactivity is wanted. Therefore, after their preheating and drying, the briquettes are carbonized by indirect heating, wherefor, the coking stage is provided with radial heating walls which are subdivided into vertical heating flues. A heating gas is burned in the flues. Gas which has been branched off the cooling circuits and taken in through a cooling stage, which primarily contains hydrogen and carbon oxide, has proved to be particularly suitable for the indirect heating mentioned above. This avoids decomposition of the gas and carbon deposits on the burner nozzles.

To eliminate tar condensation, the discharge channels for the coke oven gases in the upper part of the heating walls are provided slightly below the upper discharge channel for the combustion gases, because here, a correspondingly high temperature is still present. This location is suitable also for reasons of space saving. The free width between two heating walls in the coking zone is at least 400 mm.

If, on the contrary, the produced coke is to be used predominately for domestic combustion, a high reactivity is desired and the carbonization takes place in direct contact with hot combustion gases. For this purpose, the carbonization zone may also be equipped with exhaust arms and gas return arms, with again providing a free width between two gas exhaust arms and two gas return arms, of about 400 mm.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
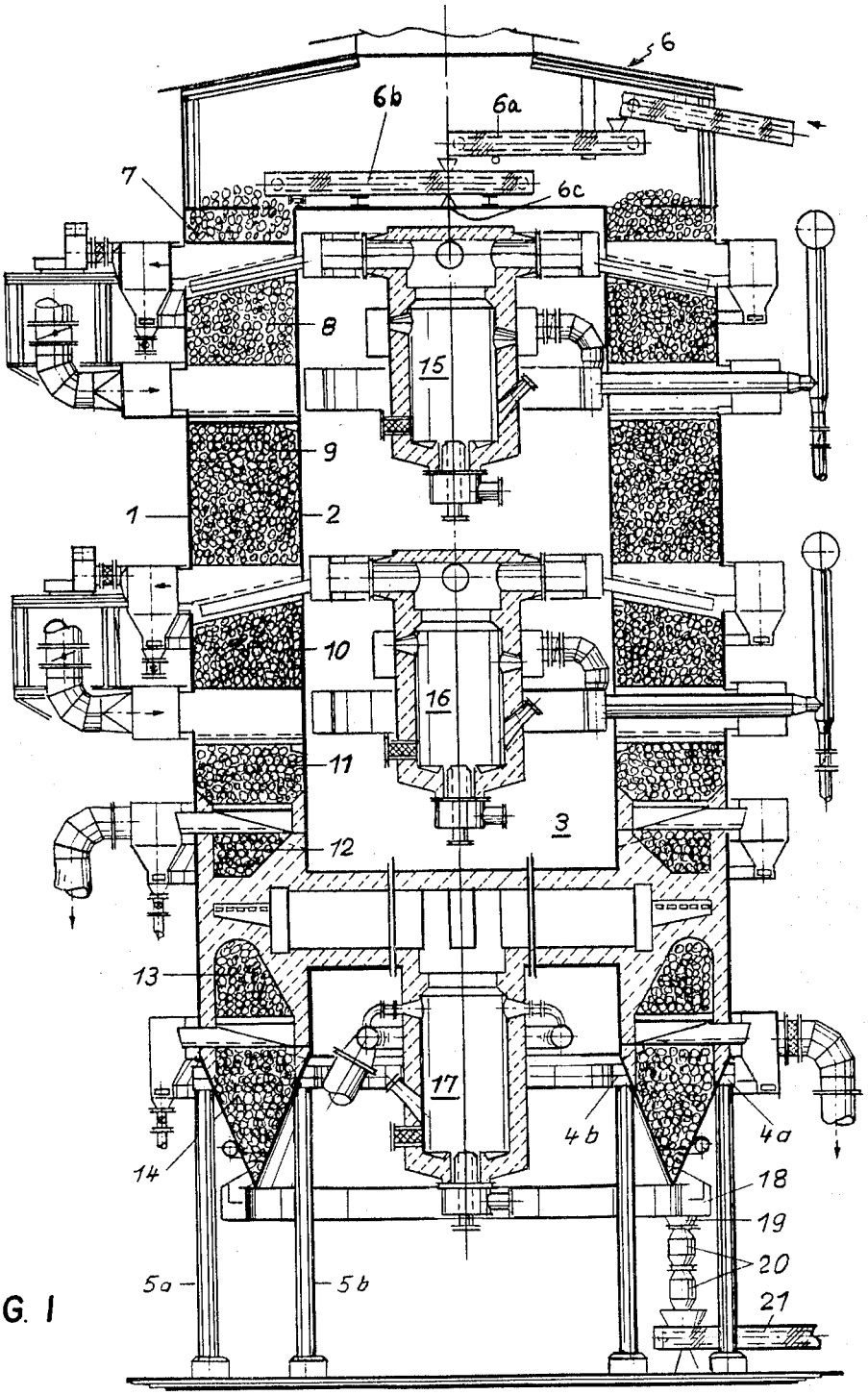
FIG. 1 is a diagrammatical, cross-sectional, side elevational view showing the entire tower furnace, constructed in accordance with the present invention.

Referring now to the drawings in particular, the invention embodied therein in FIG. 1, comprises, a tower furnace which is generally cylindrical in shape, having a top preheating stage with an annular preheating zone or section for accepting the coal material and an independent gas circuit with heater. Below this stage is a dehydrating stage having an annular dehydrating zone or section which also has an independent gas circuit and heater connected thereto. Below this stage is a carbonization stage having a carbonization zone or section also with an independent gas circuit and heater, and below this is a cooling stage having a cooling zone or section with independent gas circuits.

The outer cylindrical jacket 1 and the inner cylindrical jacket 2 of the tower furnace are shown in FIG. 1. The inner shaft space is indicated at 3. At the lower end of the tower, the inner cylindrical jacket 1 narrows conically to the inside. Outer abutment ring 4*a* and inner abutment ring 4*b* support and absorb the forces of both cylindrical jackets. The abutment rings and the entire structure are supported by legs 5*a* and 5*b*. A mechanism 6 for charging the furnace with briquettes is provided near the top of the tower, and substantially comprise a supply conveyor 6*a* and a rotary distributor 6*b*. Rotary distributor 6*b* is mounted for rotation on pivot point 6*c* to supply the annular top of the tower. The circular tower furnace is subdivided into a supply zone 7, a preheating zone 8, an isolating zone 9, a drying zone 10, an isolating zone 11, a carbonizing zone 12, an isolating zone 13, and a cooling zone 14.

The isolating zones are separating zones which serve to separate the individual gas circuits from each other. The isolating zones may be replaced by locks, which would lead to a lower overall height of the structure. Gas heaters 15, 16 and 17 are accommodated in the inner shaft 3. These may be fired with any solid, liquid or gaseous fuel. The heat produced in gas heater 15 covers the heat requirements in the preheating stage 8. The heat which is necessary in the drying zone 10 for the dehydration of the briquettes is produced in gas heater 16. Gas heater 17 furnishes the heat necessary for the carbonization process. An annular channel 18 is provided below cooling zone 14 which accommodates installations for discharging the cooled coke. Shaft 19 is provided below annular channel 18 through which the coke is discharged to the outside through locks 20. The coke is received on belt 21 and is transported to the classification plant.

Figure 2:
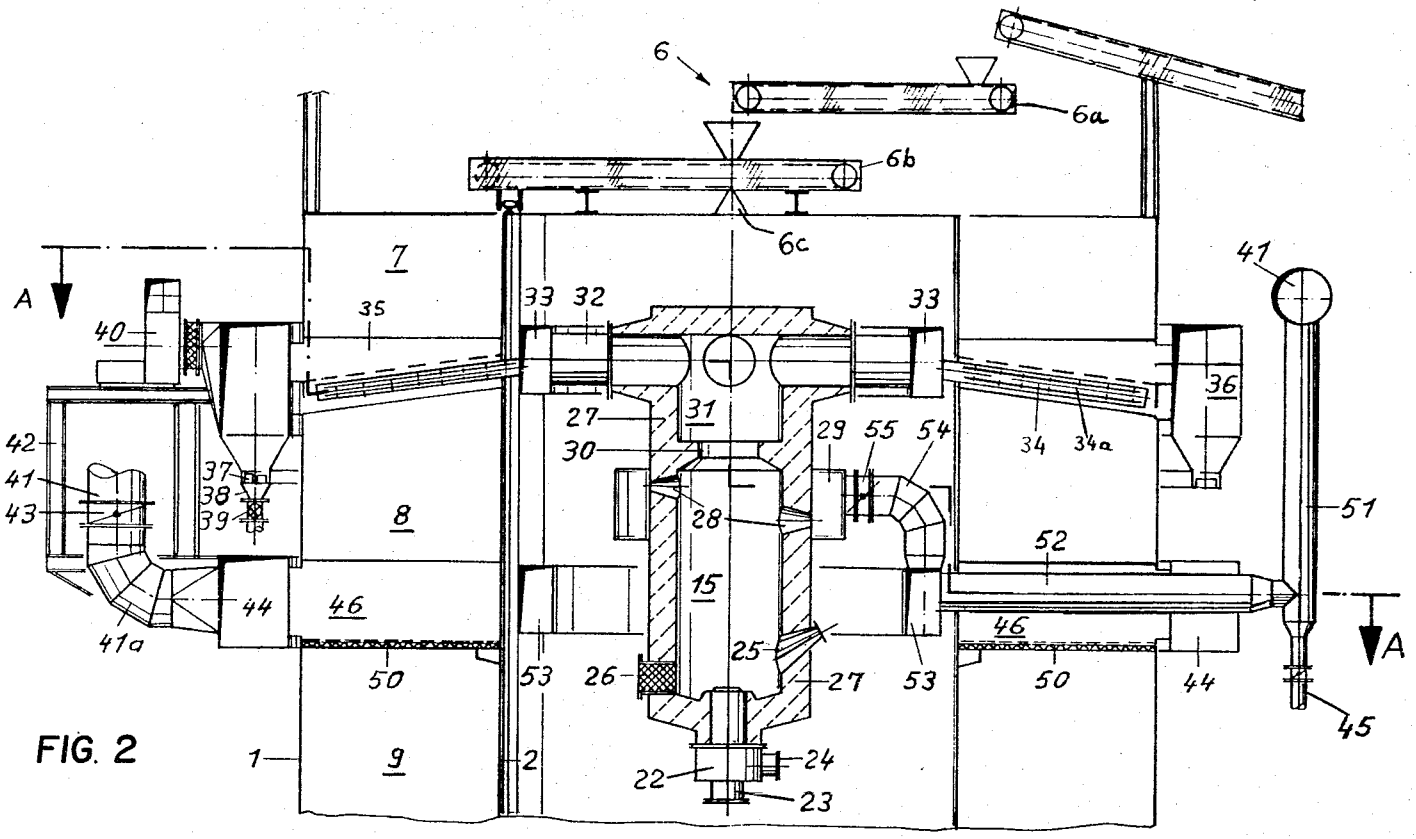
FIG. 2 is an enlarged detailted view of the upper part of the tower furnace shown in FIG. 1.

In FIG. 2, burner 22 for heater 15, is supplied with air through air supply 23 and with gas through gas supply 24. An inspection hole 25 is provided for observing the flame. A manhole is shown at 26, and the thermal insulation at 27. Cooling nozzles 28 with an annular duct 29, are provided for uniformly supplying the cooling gases, and is also provided with a gas mixing ring 30. A distributor head is shown at 31 from which the distributor arms 32 extend.

They open into an annular channel 33 (see FIG. 3 also), from which the hot gas distributor pipes or means 34 extend. The gas is metered by means of an orifice plate (not shown) which is provided at the location of transition between the annular duct 33 and the distributor arms 34. The hot gas flows from the hot gas supply line 34, having hot gas openings 34*a* into exhaust arms 35 where it mixes with the preheating gases which are taken from the briquet charge of the preheating zone and cooled.

Figure 4:
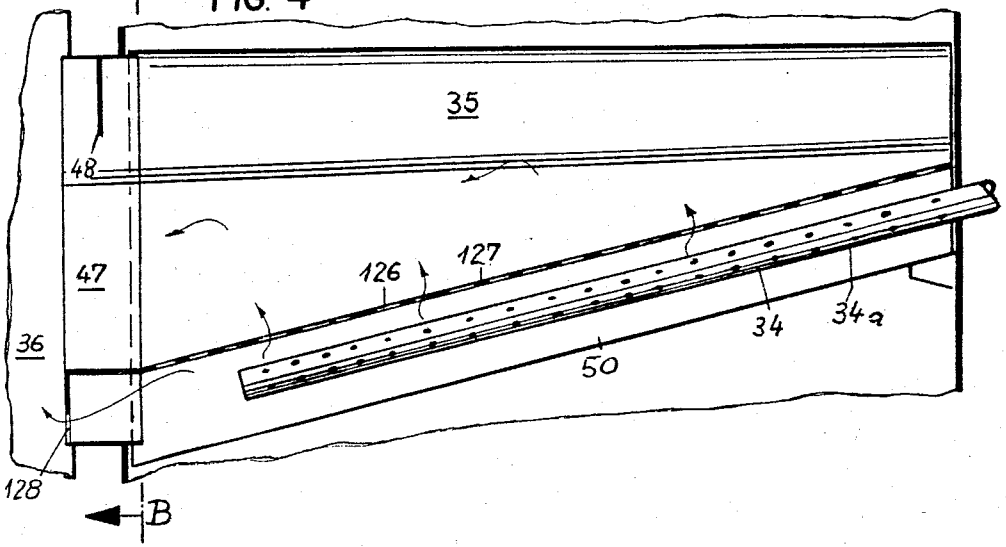
FIG. 4 is a sectional view of a detail of FIG. 2.
Figure 5:
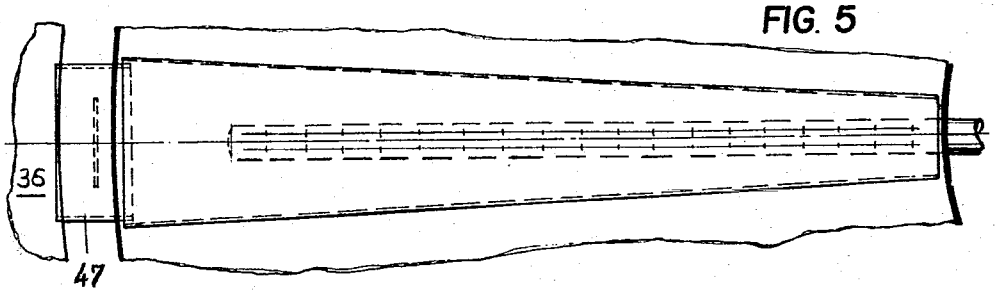
FIG. 5 is a top plan view of the showing in FIG. 4.
Figure 6:
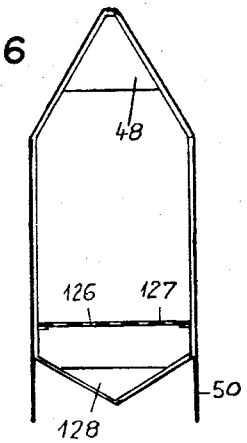
FIG. 6 is a sectional view taken along the line B—B of FIG. 4.

The preheating gases pass from the preheating zone through gas openings 126 provided in a perforated bottom 127, into exhaust arms 35 (FIGS. 4, 5 and 6). By admixing the hot gases, the preheating gases are brought to a temperature which is far enough above the dew point temperature of the whole gas, so that no condensation takes place in the following parts of the plant. An outlet aperture 128 is located below perforated bottom 127, through which a part of the gases with coarser dust particles is evacuated. The gases flow through an annular duct 36 (FIG. 2), which is dimensioned so that the dust is deposited there to a large extent. A dust displacing means, such as a scraper belt 37, conveys the dust continuously into dust pockets 38 wherefrom the dust is discharged to the outside by star wheel locks 39.

Figure 3:
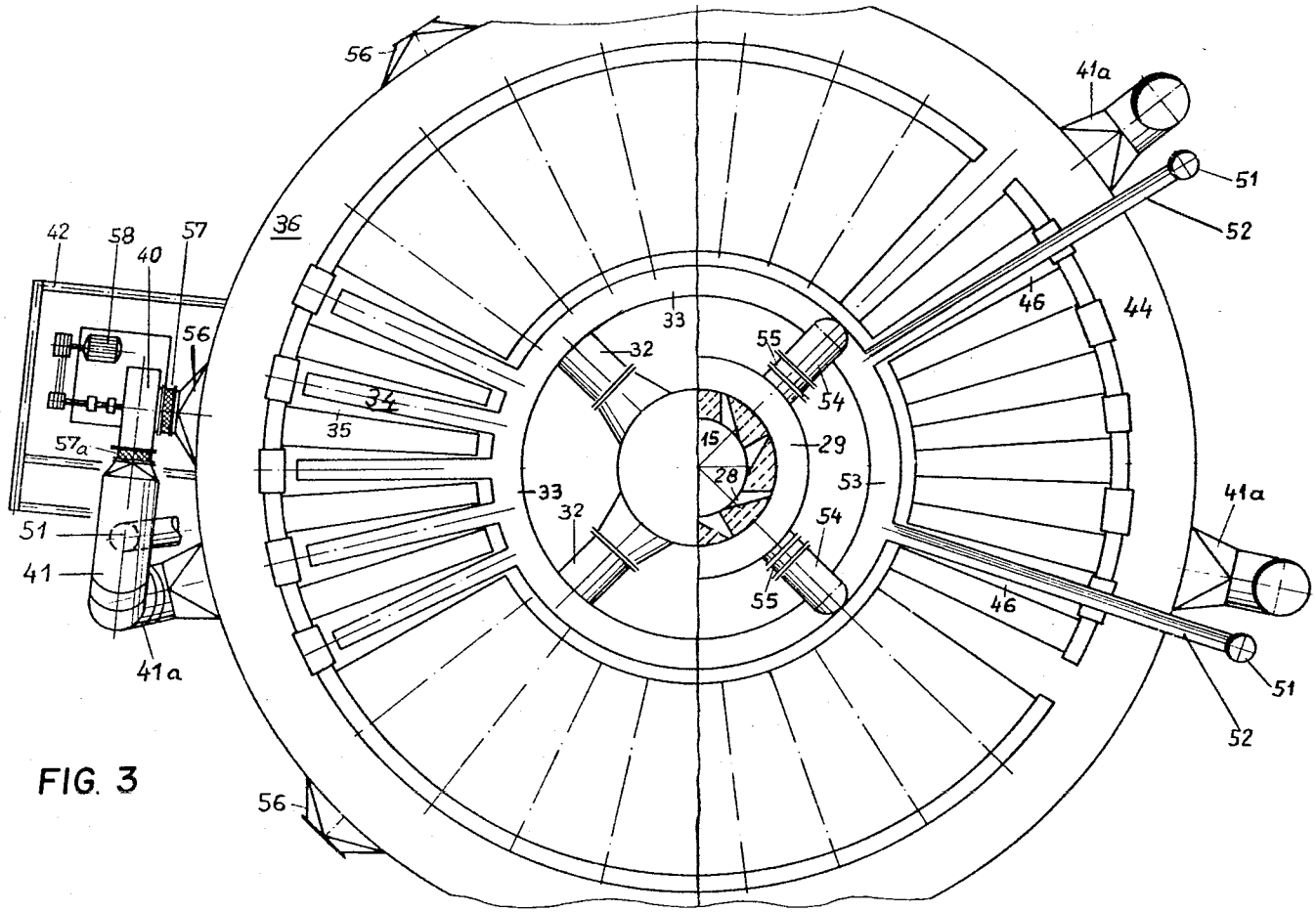
FIG. 3 is a sectional view taken along the line A—A of FIG. 2.
Figure 7:
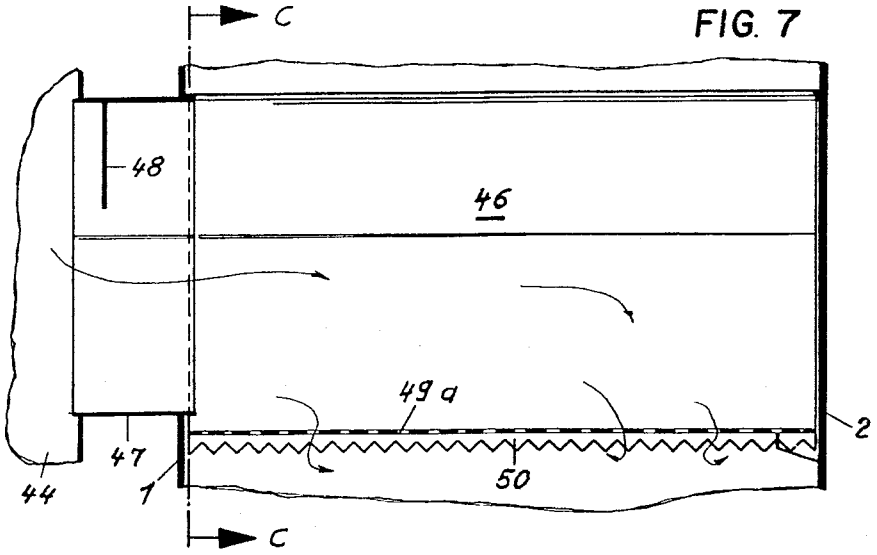
FIG. 7 is a longitudinal section of another detail of FIG. 2 showing the gas supply arms of the preheating stage.
Figure 8:
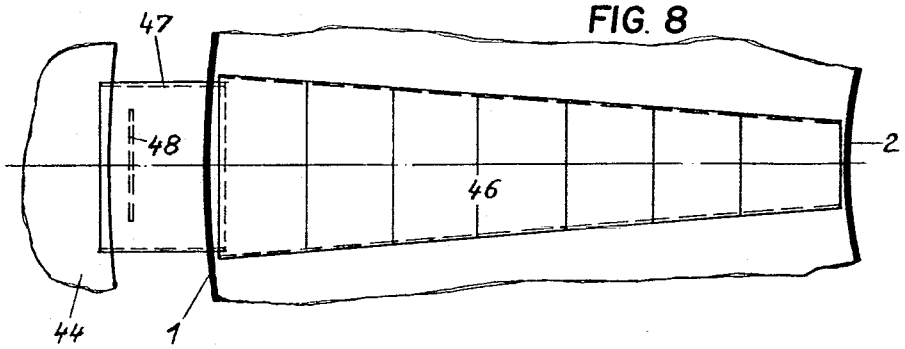
FIG. 8 is the top plan view of the showing in FIG. 7.
Figure 9:
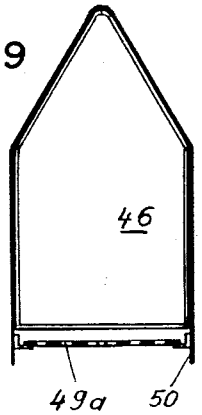
FIG. 9 is a sectional view taken along the line C—C of FIG. 7.

The gas which is substantially freed from dust, is exhausted by exhauster 40 from the annular duct 36, and is forced into a conduit 41 (see FIG. 3). A supporting structure is shown at 42. A damper 43 is provided in conduit 41 for controlling the pressure for the annular duct 44. The excess gases are evacuated in advance of damper 43 from the circuit through an outlet 45 shown in FIG. 2. Return arms 46 extend from annular duct 44 radially toward the inside of the tower. The hot circulating gases return to preheating stage 8 through the arms 46. The return arms are shown in detail in FIGS. 7, 8 and 9. Located there is an intermediate length 47 and a calibration baffle 48, with gas openings 49*a* in the bottom of a return arm 46.

The cross-section of all gas openings grows larger from the inside to the outside of the tower. This may be done either by providing increasing diameters with the same number of gas openings, or by enlarging the number of the gas openings with the same diameter. In this way, the fact that the amount of briquettes increases from the inside to the outside in accordance with the radii is taken into account. The lower edge 50 of the return arm 46 has a sawtooth shape and facilitates the uniform outflow of the gases through the openings into the charge. For a better understanding, conduit 41 with its further connections is shown only at the lefthand side of FIG. 2 and, at the righthand side, conduit 41 is shown in section.

Lines or conduits 51 and 52 lead into an annular duct 53. Duct 53 is provided in the inner shaft 3 and line 52 is provided in the interior of return arms 46 and extends across annular duct 44. This line is sealed against annular duct 44 by stuffing boxes. A control flap 55 is provided in a line 54 and cooled gases pass through annular channel 29 and nozzles 28 into the firing space of oven 15, where they are reheated. Outlet 46 (FIG. 3) provides a connection between the annular duct 36 and the exhauster 40. A vibration compensator 57 is provided therebetween for absorbing the oscillations of exhauster 40 and the drive 58 thereof. At the pressure side of the exhauster, a vibration compensator 57*a* forming a transition to line 41, is provided. Line 41 includes a bend 41*a*. The installations for the gas circuits of the drying zone 10 are designed analogically to the preheating zone. The only difference is that the gas amounts used are substantially larger.

Figure 10:
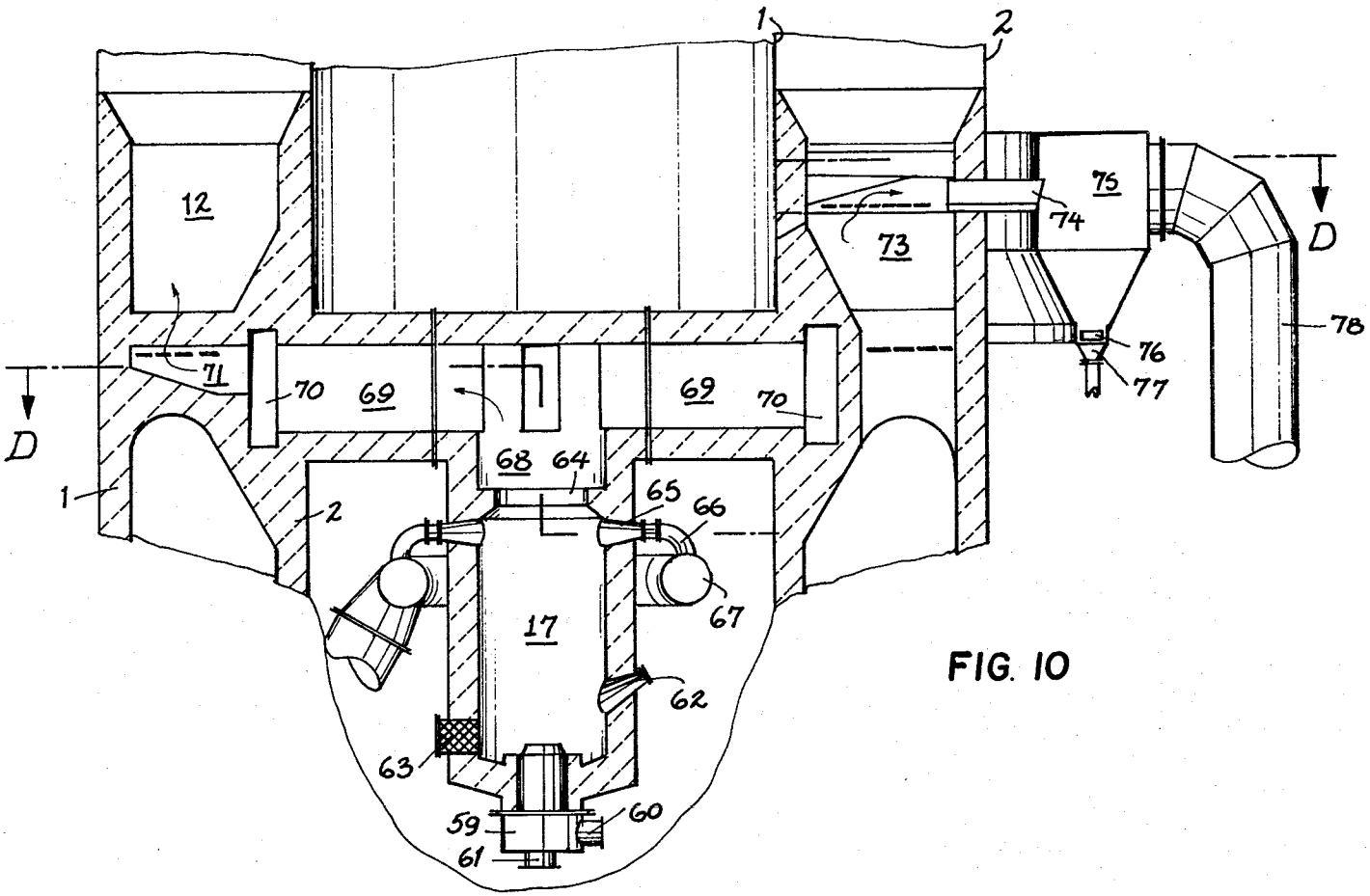
FIG. 10 is an enlarged detailed view of the carbonization zone of FIG. 1.

FIG. 10 shows an arrangement of the tower carbonization zone for direct coking. Gas heater 17 comprises a burner 59, with a fuel gas supply 60 and an air supply 61 and includes an inspection hole 62 and a manhole 63. The hot combustion gases are mixed in mixing ring 64 with the circulating inert gases which enter from branch bends 66 and annular duct 67 through nozzles 65. The gases have a temperature of about 1,150° C. to 1,200° C. and flow through the mixing space 68 and distributor arms 69, to a distributor ring 70. Calibrations which have not been shown are provided at the transition between distributor ring 70 and distributor arms 71.

Figure 11:
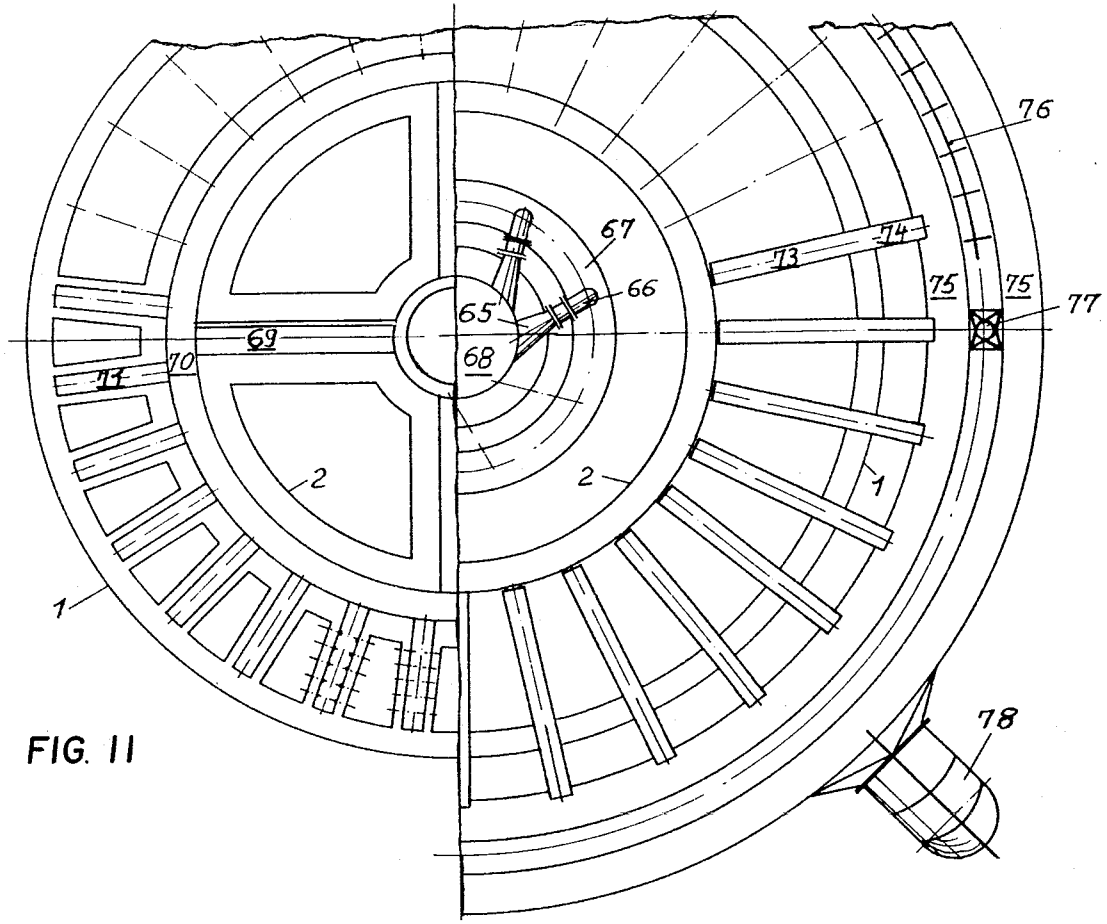
FIG. 11 is a horizontal sectional view taken along the line D—D of FIG. 10.
Figure 12:
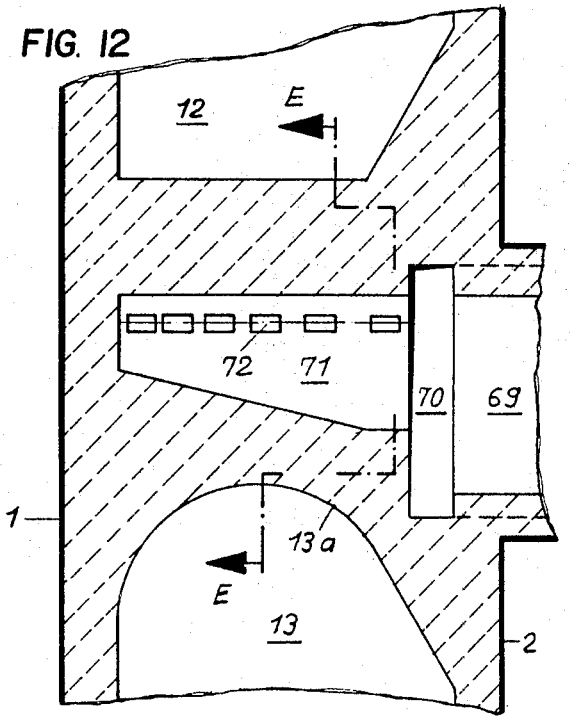
FIG. 12 is a longitudinal sectional view of a detail of the heating gas supply arm.

The arrangement of gas distributor arms 71 and the hot gas supply from the gas mixing space 68 of gas heater 17 through cross lines 69 and annular duct 70 are shown in FIG. 11 at the lefthand side thereof. The discharge of the lean gas is indicated at the righthand side of FIG. 11. FIG. 12 shows details of the gas distributor arms 71 and nozzles 72 are provided therein whose number grows larger from the inside to the outside. This allows for the fact that gas amounts increasing from the inside to the outside are to be evacuated.

Figure 13:
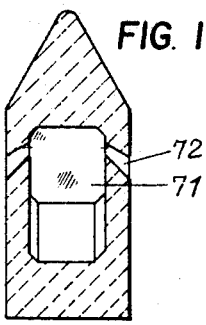
FIG. 13 is a section taken along the line E—E of FIG. 12.

FIG. 13 shows nozzles 72 directed downwardly with their inner lower edges extending above the outer upper edges thereof. This prevents solid matter from the briquette charge from penetrating into the nozzles and therethrough into distributor 71. FIG. 12 shows the vaulting designed according to sectional line 13*a* which is adapted to the ceramic and refractory material of the tower in this area.

Figure 14:
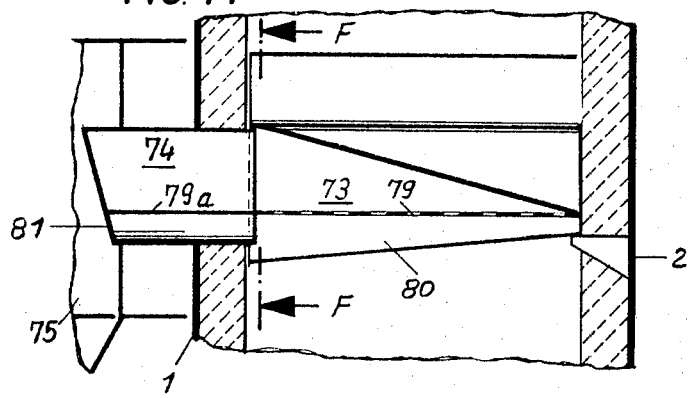
FIG. 14 is a longitudinal sectional view of a detail of a low temperature gas exhausting arm.

The hot gases flow through the briquette charge in the coking zone 12 and are evacuated by the radially outwardly extending exhaust arms 73 and intermediate connections 74 in the annular duct 75 (shown in FIG. 14). The gas velocity is reduced in annular duct 75 to such an extent that the entrained dust is substantially deposited and collected in the conical lower part of the duct. A scraper belt 76 is provided there for collecting the dust and discharging it through buckets, which have not been shown, and star wheels, as well as connections 77, to the outside. The gas, substantially freed from dust, is taken off through a tubing 78 and is directed to a condensation and gas-purifying plant.

Figure 15:
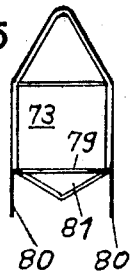
FIG. 15 is a sectional view taken along the line F—F of FIG. 14.

The motion pressure of the gas is adjusted by a control device (not shown). Details of this part of the plant are shown in FIGS. 14 and 15. Gas openings 79 are dimensioned so that the total cross-sectional area increases from the inside to the outside. The sidewalls 80 of exhaust arms 73 project downwardly by about 200 mm in order to keep the space below the gas openings 79 clear from the charge. Coarse dust is retained in this space. At the location where the exhaust arms 73 are connected to annular ducts 75, an aperture 81 is provided below the projecting sheet, with nozzles 79, through which a partial stream of the gases flows directly into annular duct 75, without being conveyed through the upper part of exhaust arms 73, that is, without passing through gas openings 79. This imparts a flow component to the gas, which becomes effective below sheet 79*a* and openings 79 and causes the turbulent dust to move upwardly toward annular ducts 75.

Figure 16:
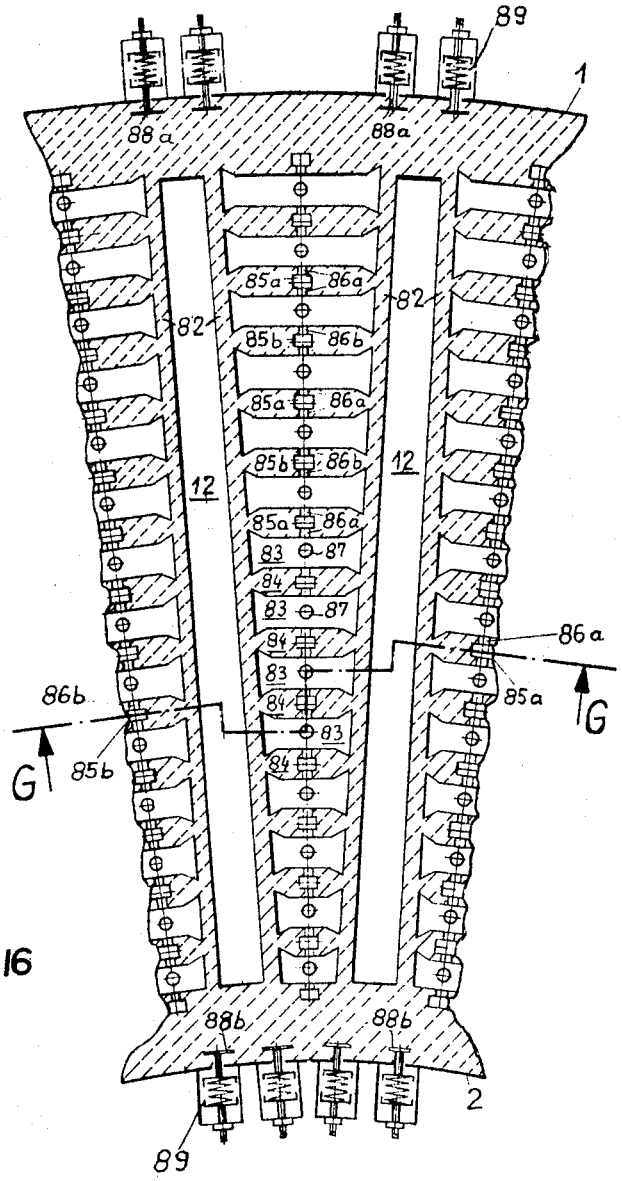
FIG. 16 is a fractional diagrammatical horizontal sectional view of the carbonization zone of FIG. 12.

The diagrammatical horizontal section according to FIG. 16 of coking zone 12 shows a design for indirect carbonization. Heating walls made of liners are indicated at 82. The individual heating flues of the heating walls are shown at 83, with binders 84 of the flues with flues 85*a* and 85*b* for the combustion air and their outlet slots 86*a* and 86*b* for the passage of the combustion air into the heating flues. Binder slots 86*a* are provided in the lower part and binder slots 86*b* in the upper part of the heating flues 83.

A bottom nozzle 87 is used for supplying the heating gas. In the carbonization zone 12, the heating wall is set under compression stress in the radial direction by pressure plates 88*a* and 88*b*, provided at different levels from the outer jacket 1 and the inner jacket 2, with this biasing pressure being produced by springs or hydraulic devices provided at the outside. The sealing of the gap where the bolts pass through the walls 1 and 2 is effected by means of stuffing boxes, which have not been shown.

Figure 17:
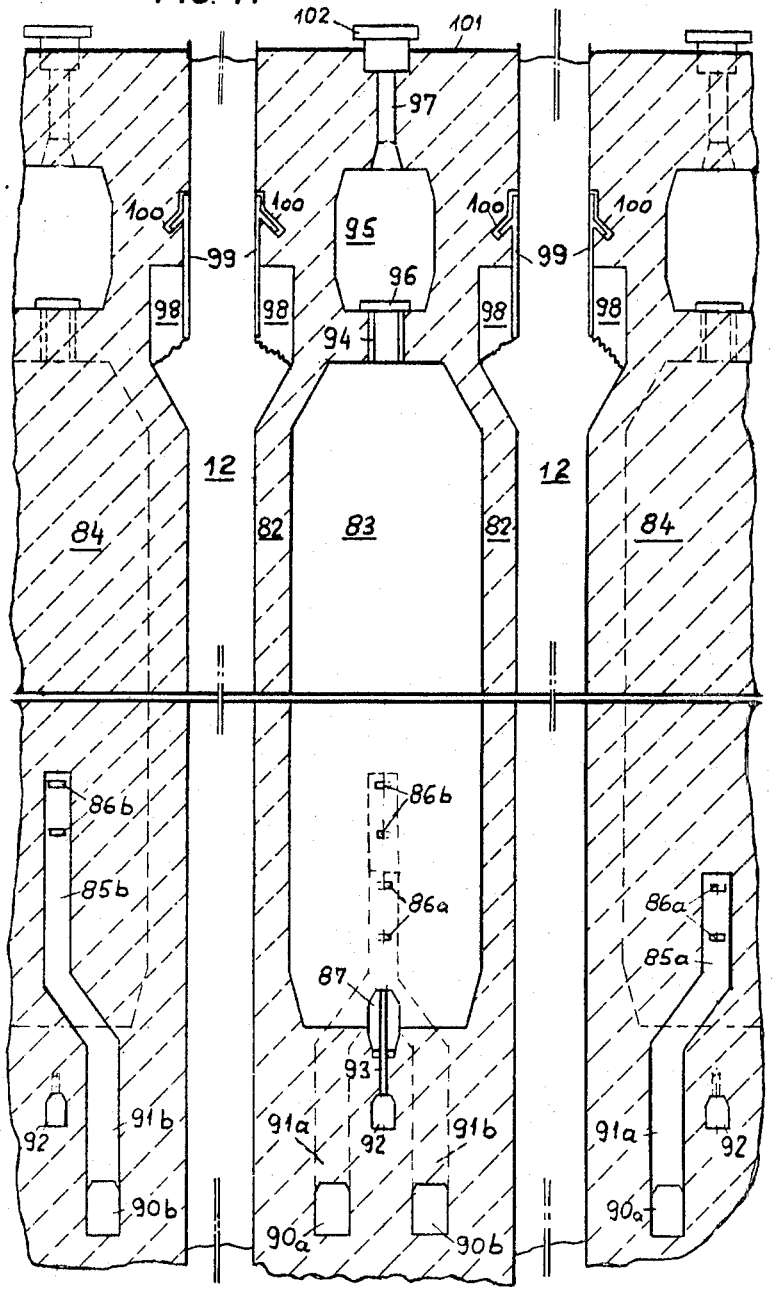
FIG. 17 is a vertical sectional view taken along the line G—G of FIG. 16.

FIG. 17 shows horizontal air channels 90*a* and 90*b* which are connected through channels 91*a* and 91*b* to binder channels 85*a* and 85*b*. A heating gas channel 92 connects line 93 to bottom nozzle 87. Heating flue 83 is connected to the horizontal flue gas exhaust channel through a channel 94. The cross-sectional area of the opening of channel 94 can be varied by displacing a slide gate 96. An inspection channel or inspection hole 97 is closed by a slider and an inspection glass provided thereabove. Inspection glass 102 is accessible for cleaning purposes. Channels 98 are provided through which the coke oven gases are removed to the outside from coking chambers 12 in the radial direction. One wall of this channel is formed by a sheet insert 99. Anchoring hooks 100 are used for suspending sheet insert 99, and includes an upper sealing sheet 101.

The cooling of the hot coke is independent of whether the coking is effected directly or indirectly. A single design of the cooling stage is provided for both variants.

Figure 18:
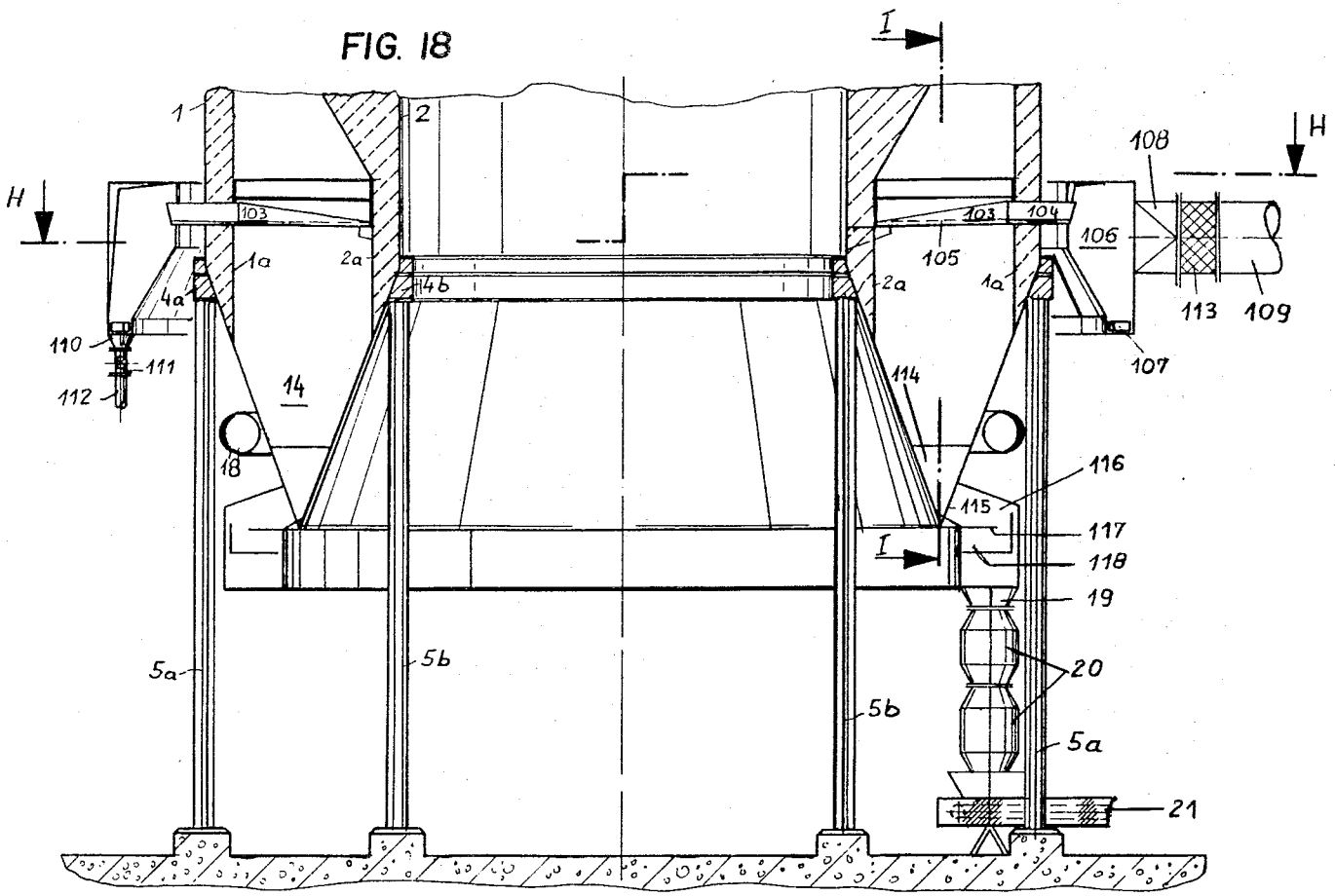
FIG. 18 is a diagrammatical longitudinal section of the cooling stage of FIG. 14.

Turning to FIGS. 18 to 21, the cooling stage 14 includes an outer jacket 1*a* of refractory material which, in this stage, is thermally insulated on the inside and includes an inner jacket 2*a* which is designed in the same manner and is provided with an outer thermal insulation (also in the interior of the shaft). An outlet 103 for the hot cooling gases is shown in FIG. 18. The last digit of the reference numerals used here roughly correspond to those used in the description of the coking stage with direct heating, so that 104 is the connection to annular channel 106; 105 is a calibration bottom for exhausting the cooling gases uniformly in the radial direction, and 107 is a scraper belt with a dust-removing pocket 110 and a star wheel 111, as well as an outlet 112. 108 is an intermediate piece to the hot cooling gas line 109 and 113 is an expansion compensator.

Figure 19:
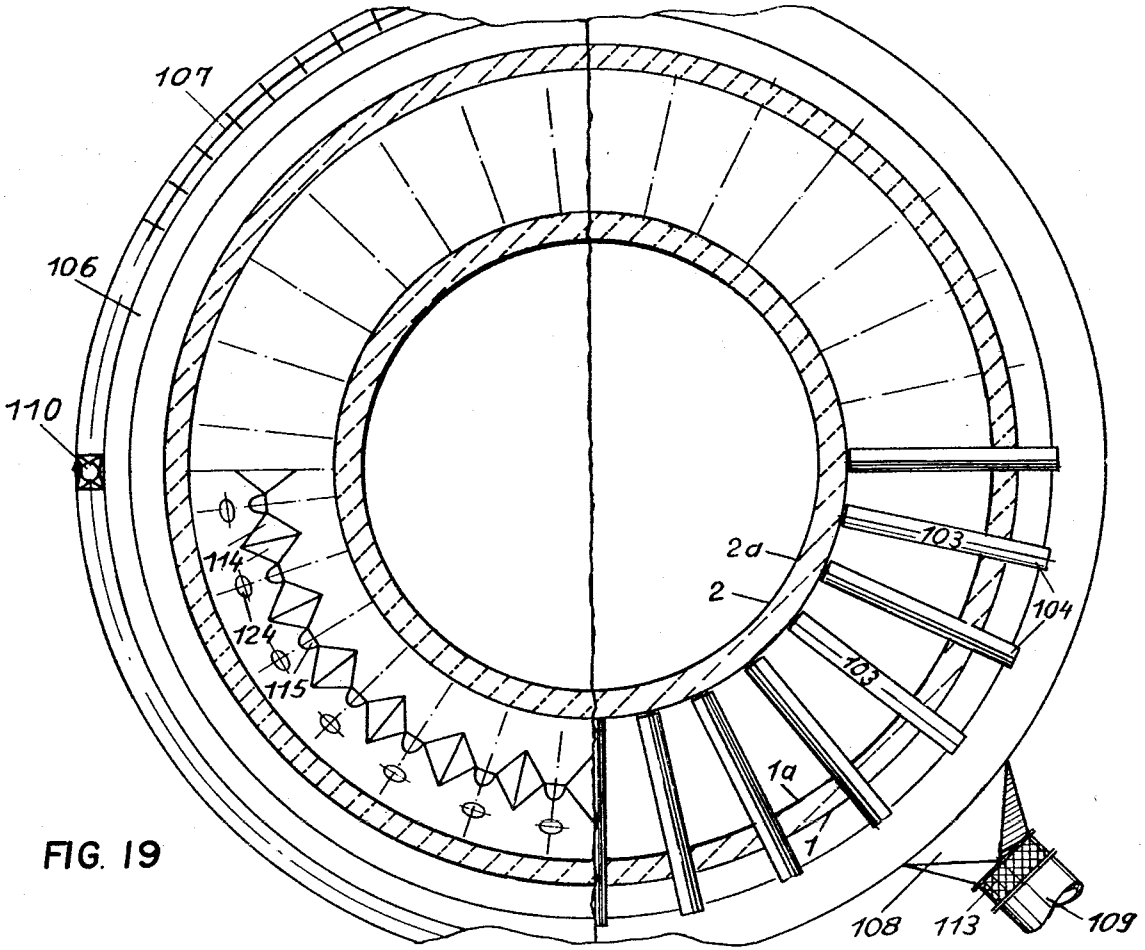
FIG. 19 is a cross-sectional view of FIG. 18, taken along the line H—H.
Figure 20:
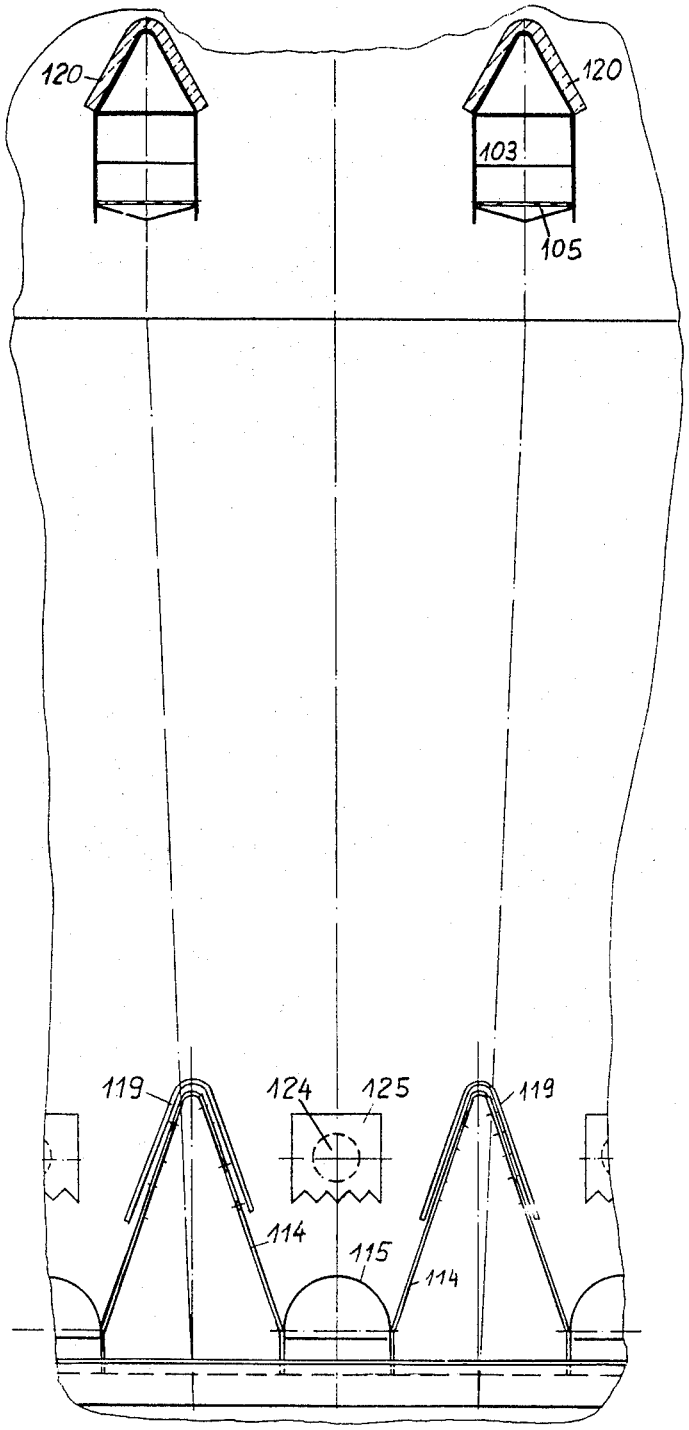
FIG. 20 is a vertical partial sectional view taken along the line I—I of FIG. 18.

In FIG. 19, 114 is the even boundary sheet of the coke outlet conically tapering downwardly. The coke outlet opening itself is indicated at 115. 116 (FIG. 21) is the annular space of the coke discharge and 117 the coke discharge table. 118 is the holding structure for stripping and conveying the cooled coke. 119 (FIG. 21) is a shielding lining to prevent wear at the coke outlets. Any very hard metal or any very hard ceramic material is suitable as the material for this lining. 120 is an outer thermal insulation of exhaust arms 103 which, at the same time, is wear-resistant (FIG. 20).

Figure 21:
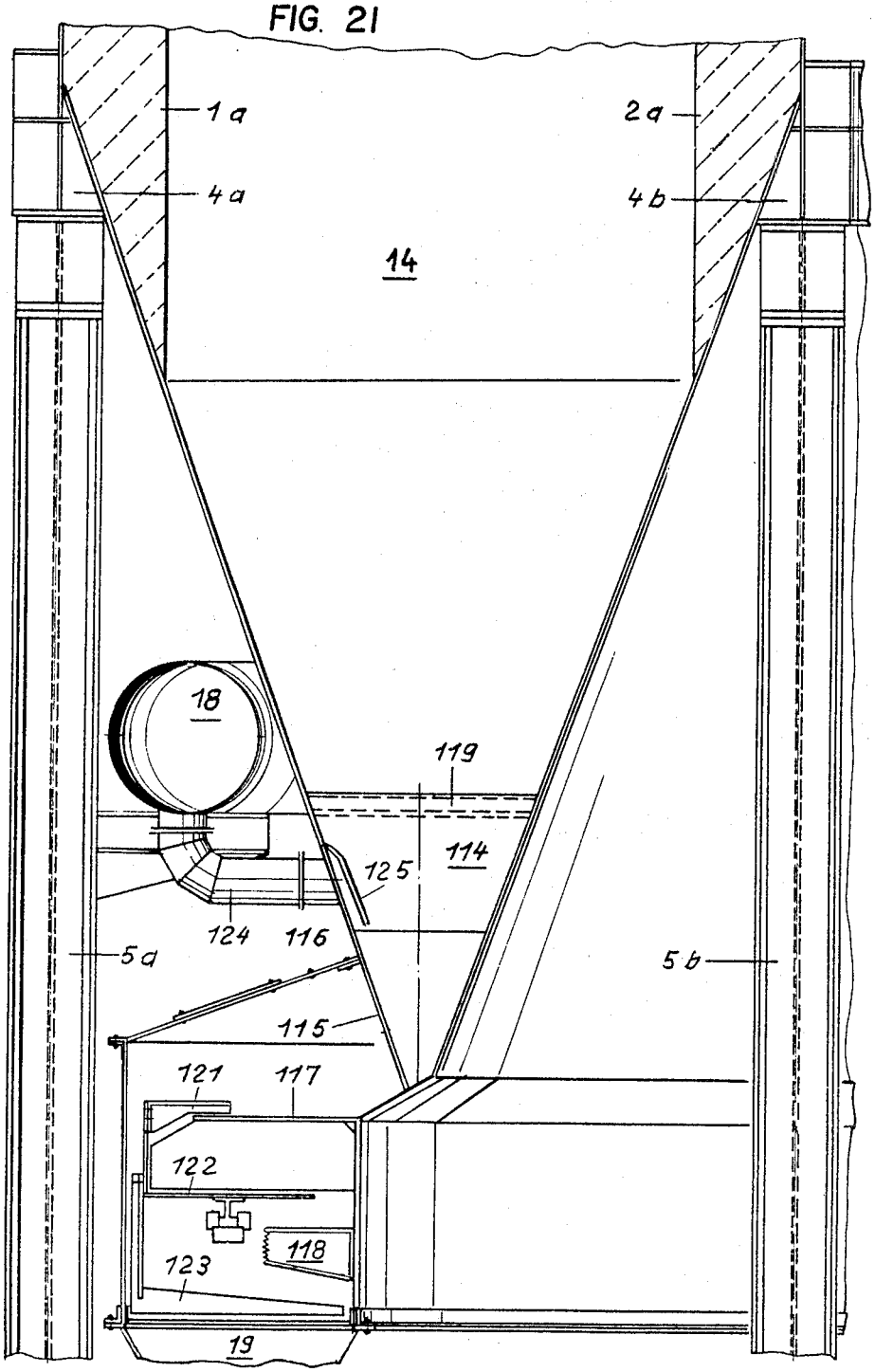
FIG. 21 is an enlarged longitudinal sectional view of the cooling stage.

In FIG. 21, 121 is a stripper and 122 a turntable. The stripper of this table is not shown. It strips the cooled coke from the turntable or carousel 122 to the discharge hopper 19. 123 are arms provided on carousel table 122 for keeping the annular discharge space 116 free from fine coke and dust. Fine coke and dust are gathered by the arms and displaced to a special discharge. Connections 124 extending from cooling gas annular dust separator 18 convey the cooling gases into the coke discharge. Connections 124 open into the coke discharge above coke discharge opening 115. 125 is a guard sheet preventing the coke from penetrating into the outlet of the cooling gas supply line 124.

While specific embodiments of the invention have been shown and described in detail to illustrate the application of the principles of the invention, it will be understood that the invention may be embodied otherwise without departing from such principles.

What is claimed is:

1. A device for producing abrasion-proof coke forms from bituminous or brown coal briquettes, charcoal or peat, comprising, a preheating stage having a preheating section, a preheating gas circuit for supplying gas to said preheating section and a heater in said preheating gas circuit; a dehydrating stage associated with said preheating stage, having a dehydrating section, a dehydrating gas circuit for supplying gas to said dehydrating section and a heater in said dehydrating gas circuit; a carbonization stage associated with said dehydrating stage, having a carbonization section, a carbonization gas circuit for supplying gas to said carbonization section and a heater in said carbonization gas circuit; a cooling stage associated with said carbonization stage, having a cooling section and a cooling gas circuit for supplying gas to said cooling section; said preheating; dehydrating, carbonization and cooling sections being stacked to form a tower furnace; and an inner circular cross-sectioned jacket and an outer circular cross-sectioned jacket defining an annular space therebetween forming each of said sections with a shaft space defined in said inner circular cross-sectioned jacket, said heaters of said preheating and dehydrating stage disposed in said shaft space.

2. A device for producing abrasion-proof coke forms, as claimed in claim 1, wherein said heater for said carbonization stage is disposed in said shaft space.

3. A device for producing abrasion-proof coke forms, as claimed in claim 1, further including a plurality of circumferentially spaced radially extending exhaust arms in at least one of said preheating and dehydrating sections which are disposed in the upper portion of the tower furnace, hot gas distributor means extending from said heater of said at least one preheating and dehydrating sections and into said exhaust arms, said hot gas distributor means including a plurality of hot gas openings for supplying waste gas from said heater to said exhaust arms, a bottom member in each of said exhaust arms having a plurality of openings therethrough with said hot gas distributor means below said bottom member, an exhauster connected to the radial outer ends of said exhaust arms for receiving waste gas supplied from said hot gas distributor means and through said openings of said bottom member, said exhauster having a high pressure side, and a plurality of circumferentially spaced radially extending gas return arms in said at least one of said preheating and dehydrating sections, each of said gas return arms connected to said high pressure side of said exhauster and including a bottom portion having a plurality of gas openings therethrough.

4. A device for producing abrasion-proof coke forms, as claimed in claim 3, further including an annular dust separator duct connected between each of said exhaust arms and said exhauster.

5. A device for producing abrasion-proof coke forms, as claimed in claim 4, in which said outer circular cross-sectioned jacket includes an aperture communicating each of said exhaust arms below said bottom members with said annular dust separator duct, the cross-sectional area of each of said apertures having a proportion to the total hot gas openings of each of said bottom members of 1:10.

6. A device for producing abrasion-proof coke forms, as claimed in claim 5, wherein the vertical distance between the lower edge of said exhaust arms and the upper edge of said aperture associated therewith is less than 100 mm.

7. A device for producing abrasion-proof coke forms, as claimed in claim 4, wherein said annular dust separating duct further includes at least one dust collecting pocket, dust displacement means in said annular dust separating duct for displacing dust therein into said dust collecting pocket and a discharge lock connected to said dust collecting pocket for discharging the dust therein.

8. A device for producing abrasion-proof coke forms, as claimed in claim 3, wherein each of said exhaust arms and said gas return arms include an upper portion having an acute equal sided triangular cross-section with an upwardly directed acute angle.

9. A device for producing abrasion-proof coke forms, as claimed in claim 8, wherein said gas return arms each have lower edges with a sawtooth shape.

10. A device for producing abrasion-proof coke forms, as claimed in claim 3, wherein each of said exhaust and gas return arms have cross-sectional areas which decrease in the radial inward direction of said tower furnace, whereby, a constant gas velocity for the supplied gases is effected for different gas amounts.

11. A device for producing abrasion-proof coke forms, as claimed in claim 3, further including a thermally insulated layer connected to the inside surface of said exhaust arms.

12. A device for producing abrasion-proof coke forms, as claimed in claim 3, wherein the number of openings in said bottom member of said exhaust arms increases in the radially outward direction of said tower furnace.

13. A device for producing abrasion-proof coke forms, as claimed in claim 3, wherein the horizontal free space between adjacent exhaust arms is at least 600 mm.

14. A device for producing abrasion-proof coke forms, as claimed in claim 3, wherein the horizontal free space between adjacent gas return arms is at least 600 mm.

15. A device for producing abrasion-proof coke forms, as claimed in claim 1, wherein said carbonization stage further includes a plurality of radially extending heating walls for subdividing said carbonization section into a plurality of radially extending coking sections and for defining a plurality of heating flues for heating said coking sections.

16. A device for producing abrasion-proof coke forms, as claimed in claim 15, further including a plurality of waste gas evacuation channels defined between said walls for evacuating waste gas from said carbonization flues and a plurality of coking gas evacuation channels defined in the upper portion of said heating walls with said coking evacuation channels disposed slightly below said waste gas evacuation channels.

17. A device for producing abrasion-proof coke forms, as claimed in claim 1, further including a plurality of circumferentially spaced radially extending exhaust arms in said carbonization section and a plurality of circumferentially spaced radially extending distribution arms in said carbonization section disposed below said plurality of exhaust arms.

18. A device for producing abrasion-proof coke forms, as claimed in claim 17, wherein the horizontal free space between adjacent exhaust arms and between adjacent gas distribution arms are at least 400 mm.

19. In a device for producing abrasion-proof coke forms from bituminous or brown coal briquettes, charcoal or peat including one operating stage for each of the operations of preheating, dehydrating, carbonizing and cooling, with each of the stages including a separate gas circuit with separate heaters for the gas circuits of the preheating, dehydrating and carbonizing stages, the improvement comprising, the preheating, dehydrating, carbonizing and cooling stages stacked one atop the other in a tower furnace form with respective preheating, dehydrating, carbonizing and cooling sections each being of annular shape and disposed between concentric inner and outer cylindrical jackets with the heaters for the preheating and dehydrating stage disposed in an inner shaft space within said inner concentric cylindrical jacket.

20. The device of claim 19, wherein the separate gas circuit of said carbonizing stage comprises a plurality of circumferentially spaced hot gas distributor arms extending radially through said annular carbonizing section having a radially inward end connected to the heater of said carbonizing section for distributing hot gases from said heater in said carbonizing stage to said carbonizing section.

21. The device of claim 20, wherein said carbonizing stage further includes a plurality of circumferentially spaced exhaust arms extending radially through said carbonizing section above said radially extending distributor arms for receiving the gases supplied from said distributor arms and through said carbonizing section, each of said carbonizing section exhaust arms connected at their radially outward ends to an annular carbonization gas collecting duct.

22. The device of claim 21, wherein said distributor and exhaust arms of said carbonization stage include a plurality of gas openings decreasing in cross-sectional area in the radially outward direction in said carbonizing section.

23. The device of claim 19, wherein, in the vicinity of said cooling stage, said inner cylindrical jacket diverges conically outwardly and said outer cylindrical jacket converges conically inwardly to meet said outer cylindrical jacket to form said annular cooling section.

24. The device of claim 23, further including an annular coke receiving duct below said cooling section with openings defined through said cooling section communicating with said coke collecting duct and a rotatably mounted carousel in said coke collecting duct for removing coke from said cooling section.

25. The device of claim 19, wherein said preheating section is disposed above said dehydrating section and includes at least one opening at the top thereof and a rotatably mounted conveyor having an output end movable into the vicinity of said opening at the top of said preheating section, said conveyor being rotated to distribute coal to said preheating section.

26. The improvement of claim 19, further including insulation sections defined between said preheating and dehydrating sections, between said dehydrating and carbonizing sections and between said carbonizing and cooling sections, each of said insulating sections representing an annular space between said inner and outer cylindrical jackets communicating said respective preheating, dehydrating, carbonizing and cooling sections, each of said annular spaces adapted to receive the coke forms to provide insulation between said respective preheating, dehydrating, carbonizing and cooling sections.

* * * * *